US011195467B2

(12) United States Patent
Yue et al.

(10) Patent No.: US 11,195,467 B2
(45) Date of Patent: Dec. 7, 2021

(54) PIXEL DRIVING CIRCUIT AND DISPLAY DEVICE

(71) Applicant: BOE TECHNOLOGY GROUP CO., LTD., Beijing (CN)

(72) Inventors: Han Yue, Beijing (CN); Can Zhang, Beijing (CN); Can Wang, Beijing (CN); Angran Zhang, Beijing (CN); Minghua Xuan, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/918,960

(22) Filed: Jul. 1, 2020

(65) Prior Publication Data

US 2021/0166629 A1 Jun. 3, 2021

(30) Foreign Application Priority Data

Nov. 29, 2019 (CN) ..... 201922099248.9

(51) Int. Cl.
*G09G 3/3258* (2016.01)

(52) U.S. Cl.
CPC ... *G09G 3/3258* (2013.01); *G09G 2300/0426* (2013.01); *G09G 2300/0842* (2013.01); *G09G 2330/028* (2013.01)

(58) Field of Classification Search
CPC ..... G09G 3/3233; G09G 3/3258; G09G 2300/0426; G09G 2300/0809; G09G 2300/0842; G09G 2300/0861; G09G 2300/0866; G09G 2330/028
USPC ..... 345/691
See application file for complete search history.

(56) References Cited

U.S. PATENT DOCUMENTS

| | | | | |
|---|---|---|---|---|
| 8,816,942 | B2 * | 8/2014 | Schwanenberger | G09G 3/3233 345/77 |
| 9,299,319 | B2 * | 3/2016 | Han | G09G 3/2022 |
| 9,626,905 | B2 * | 4/2017 | In | G09G 3/2022 |
| 9,691,329 | B2 * | 6/2017 | Kwon | G09G 3/3233 |
| 9,892,688 | B2 * | 2/2018 | In | G09G 3/3266 |
| 10,152,919 | B2 * | 12/2018 | Ota | G09G 3/3233 |
| 10,839,754 | B2 * | 11/2020 | Kim | G09G 3/3291 |
| 2007/0091029 | A1 * | 4/2007 | Uchino | G09G 3/3233 345/76 |
| 2008/0088547 | A1 * | 4/2008 | Chan | G09G 3/3233 345/76 |
| 2011/0279436 | A1 * | 11/2011 | Komiya | G09G 3/3233 345/212 |
| 2013/0147694 | A1 * | 6/2013 | Kim | G09G 3/3659 345/82 |

(Continued)

*Primary Examiner* — Tom V Sheng
(74) *Attorney, Agent, or Firm* — McCoy Russell LLP

(57) ABSTRACT

A pixel driving circuit and a display device are provided. The pixel driving circuit includes a voltage control circuit and a light-emitting time control circuit. The voltage control circuit is configured to control a voltage at a voltage writing node according to a first data voltage on a first data line; the light-emitting time control circuit is configured to connect the voltage writing node to a first electrode of a light-emitting device or disconnect the voltage writing node from the first electrode of the light-emitting device according to a second data voltage on a second data line and a reference voltage at a reference voltage terminal; and a second electrode of the light-emitting device is electrically connected to a first voltage terminal.

13 Claims, 4 Drawing Sheets

(56) References Cited

U.S. PATENT DOCUMENTS

| | | | | |
|---|---|---|---|---|
| 2014/0084805 | A1* | 3/2014 | Kim | G09G 3/2048 315/228 |
| 2014/0184665 | A1* | 7/2014 | Yoon | G09G 3/3233 345/691 |
| 2015/0379956 | A1* | 12/2015 | Nonaka | G09G 3/325 315/172 |
| 2016/0132171 | A1* | 5/2016 | Hu | G02F 1/13338 345/174 |
| 2016/0275869 | A1* | 9/2016 | Hwang | G09G 3/3258 |
| 2019/0114972 | A1* | 4/2019 | Feng | G09G 3/3233 |
| 2019/0130833 | A1* | 5/2019 | Gao | G09G 3/3233 |
| 2019/0164502 | A1* | 5/2019 | Yoon | G09G 3/3233 |
| 2019/0251905 | A1* | 8/2019 | Yang | G09G 3/3233 |
| 2020/0202785 | A1* | 6/2020 | Yang | G06F 3/0445 |
| 2020/0342813 | A1* | 10/2020 | Gao | G09G 3/3258 |
| 2021/0158757 | A1* | 5/2021 | Xuan | G09G 3/3291 |

* cited by examiner

PIXEL DRIVING CIRCUIT AND DISPLAY DEVICE

CROSS-REFERENCE TO RELATED APPLICATION

The present application claims priority to Chinese Patent Application No. 201922099248.9 filed on Nov. 29, 2019. The entire contents of the above-listed application are hereby incorporated by reference for all purposes.

TECHNICAL FIELD

The present disclosure relates to the field of display technologies, in particular to a pixel driving circuit and a display device.

BACKGROUND

Research and development of virtual reality (VR) technologies have gained momentum in the display industry recently, and the VR technologies have undergone increasingly widespread application. In order to achieve a more convincing reproduction of real world and minimize graininess after optical magnification, a product with a Pixels Per Inch (PPI) of more than 2000 is usually required in VR, so a high-PPI display product is required. Conventionally, glass substrate products are limited in PPI, as a result, most VR near-eye products or Augmented Reality (AR) near-eye products rely on silicon substrate micro displays.

SUMMARY

A pixel driving circuit is provided in the present disclosure, including a voltage control circuit and a light-emitting time control circuit. The voltage control circuit is electrically connected to a first data line and a voltage writing node respectively, and configured to control a voltage at the voltage writing node according to a first data voltage on the first data line; the light-emitting time control circuit is electrically connected to a second data line, the voltage writing node, a reference voltage terminal and a first electrode of a light-emitting device respectively, and configured to connect the voltage writing node to the first electrode of the light-emitting device or disconnect the voltage writing node from the first electrode of the light-emitting device according to a second data voltage on the second data line and a reference voltage at the reference voltage terminal; and a second electrode of the light-emitting device is electrically connected to a first voltage terminal.

In an implementation, the light-emitting time control circuit includes a light-emitting time control transistor, a second data voltage writing circuit and a time control capacitor. A control electrode of the light-emitting time control transistor is electrically connected to a control node, a first electrode of the light-emitting time control transistor is electrically connected to the voltage writing node, and a second electrode of the light-emitting time control transistor is connected to the first electrode of the light-emitting device. The second data voltage writing circuit is electrically connected to the second data line and the control node respectively, and configured to write the second data voltage on the second data line to the control node under control of a second data voltage writing control signal; a first terminal of the time control capacitor is electrically connected to the control node, and a second terminal of the time control capacitor is electrically connected to the reference voltage terminal.

In an implementation, the second data voltage writing circuit includes a first transistor and a second transistor. The second data voltage writing control signal includes a first gate driving signal and a second gate driving signal. A control electrode of the first transistor is electrically connected to a first gate line, a first electrode of the first transistor is electrically connected to the second data line, and a second electrode of the first transistor is electrically connected to the control node. A control electrode of the second transistor is electrically connected to a second gate line, a first electrode of the second transistor is electrically connected to the second data line, and a second electrode of the second transistor is electrically connected to the control node. The first gate line is configured to provide the first gate driving signal, and the second gate line is configured to provide the second gate driving signal. The first transistor is an n-type transistor, and the second transistor is a p-type transistor.

In an implementation, the pixel driving circuit according to the present disclosure further includes a light-emitting control circuit. The light-emitting control circuit is connected between the light-emitting time control circuit and the first electrode of the light-emitting device, and configured to connect the light-emitting time control circuit to the first electrode of the light-emitting device under control of a light-emitting control signal on a light-emitting control line.

In an implementation, the light-emitting control circuit includes a light-emitting control transistor. A control electrode of the light-emitting control transistor is electrically connected to the light-emitting control line, a first electrode of the light-emitting control transistor is electrically connected to the light-emitting time control circuit, and a second electrode of the light-emitting control transistor is electrically connected to the first electrode of the light-emitting device.

In an implementation, the voltage control circuit includes a first data voltage writing circuit, a source follower transistor and a storage capacitor. A gate electrode of the source follower transistor is electrically connected to a first node, a drain electrode of the source follower transistor is electrically connected to a power supply voltage terminal, and a source electrode of the source follower transistor is electrically connected to the voltage writing node. The first data voltage writing circuit is electrically connected to the first data line and the first node respectively, and configured to write the first data voltage on the first data line to the first node under control of a first data voltage writing control signal. A first terminal of the storage capacitor is electrically connected to the first node, and a second terminal of the storage capacitor is electrically connected to the power supply voltage terminal.

In an implementation, the first data voltage writing control signal includes a third gate driving signal and a fourth gate driving signal. The first data voltage writing circuit includes a third transistor and a fourth transistor. A control electrode of the third transistor is electrically connected to a third gate line, a first electrode of the third transistor is electrically connected to the first data line, and a second electrode of the third transistor is electrically connected to the first node. A control electrode of the fourth transistor is electrically connected to a fourth gate line, a first electrode of the fourth transistor is electrically connected to the first data line, and a second electrode of the fourth transistor is electrically connected to the first node. The third gate line is configured to provide the third gate driving signal, and the fourth gate line is configured to provide the fourth gate driving signal. The third transistor is an n-type transistor, and the fourth transistor is a p-type transistor.

In an implementation, the pixel driving circuit further includes a light-emitting control circuit. The light-emitting time control circuit includes a light-emitting time control transistor, a second data voltage writing circuit and a time control capacitor. A gate electrode of the light-emitting time control transistor is electrically connected to a control node, a source electrode of the light-emitting time control transistor is electrically connected to the voltage writing node. A first terminal of the time control capacitor is electrically connected to the control node, and a second terminal of the time control capacitor is electrically connected to the reference voltage terminal. The second data voltage writing circuit includes a first transistor and a second transistor, the first transistor is an n-type transistor, and the second transistor is a p-type transistor. A gate electrode of the first transistor is electrically connected to a first gate line, a source electrode of the first transistor is electrically connected to a second data line, and a drain electrode of the first transistor is electrically connected to the control node. A gate electrode of the second transistor is electrically connected to a second gate line, a drain electrode of the second transistor is electrically connected to the second data line, and a source electrode of the second transistor is electrically connected to the control node. The first gate line is configured to provide a first gate driving signal, and the second gate line is configured to provide a second gate driving signal. The light-emitting control circuit includes a light-emitting control transistor, a gate electrode of the light-emitting control transistor is electrically connected to a light-emitting control line, a source electrode of the light-emitting control transistor is electrically connected to a drain electrode of the light-emitting time control transistor, a drain electrode of the light-emitting control transistor is electrically connected to an anode of an organic light-emitting diode, and a cathode of the organic light-emitting diode is electrically connected to the first voltage terminal. The voltage control circuit includes a first data voltage writing circuit, a source follower transistor and a storage capacitor. A gate electrode of the source follower transistor is electrically connected to a first node, a drain electrode of the source follower transistor is electrically connected to a power supply voltage terminal, and a source electrode of the source follower transistor is electrically connected to the voltage writing node; the power supply voltage terminal is configured to provide a power supply voltage. A first terminal of the storage capacitor is electrically connected to the first node, and a second terminal of the storage capacitor is electrically connected to the power supply voltage terminal. The first data voltage writing circuit includes a third transistor and a fourth transistor, the third transistor is an n-type transistor, and the fourth transistor is a p-type transistor. A gate electrode of the third transistor is electrically connected to a third gate line, a source electrode of the third transistor is electrically connected to the first data line, and a drain electrode of the third transistor is electrically connected to the first node. A gate electrode of the fourth transistor is electrically connected to a fourth gate line, a drain electrode of the fourth transistor is electrically connected to the first data line, and a source electrode of the fourth transistor is electrically connected to the first node. The third gate line is configured to provide a third gate driving signal, and the fourth gate line is configured to provide a fourth gate driving signal.

A pixel driving method applied to the pixel driving circuit described above is further provided in the present disclosure, including: in a first data writing stage, controlling, by the voltage control circuit, the voltage at the voltage writing node to be a first control voltage according to the first data voltage on the first data line; in a second data writing stage, disconnecting, by the light-emitting time control circuit, the voltage writing node from the first electrode of the light-emitting device according to the second data voltage on the second data line; and in a light-emitting stage, switching, by the light-emitting time control circuit, a connection between the voltage writing node and the first electrode of the light-emitting device from a disconnected status to a connected status according to the second data voltage and a reference voltage at the reference voltage terminal; wherein the reference voltage at the reference voltage terminal changes with time.

In an implementation, the reference voltage at the reference voltage terminal changes linearly with time.

In an implementation, the pixel driving circuit further includes a light-emitting control circuit; the pixel driving method further includes: in the light-emitting stage, connecting, by the light-emitting control circuit, the light-emitting time control circuit to the first electrode of the light-emitting device under control of a light-emitting control signal on a light-emitting control line.

In an implementation, the light-emitting time control circuit includes a light-emitting time control transistor, the light-emitting stage includes a light-emitting preparation time period and a light-emitting time period, and the switching, by the light-emitting time control circuit, a connection between the voltage writing node and the first electrode of the light-emitting device from a disconnected status to a connected status according to the second data voltage and a reference voltage at the reference voltage terminal in the light-emitting stage includes: in the light-emitting preparation time period, disconnecting, by the light-emitting time control circuit, the voltage writing node from the first electrode of the light-emitting device according to the second data voltage and a first reference voltage at the reference voltage terminal; in the light-emitting time period, connecting, by the light-emitting time control circuit, the voltage writing node to the first electrode of the light-emitting device according to the second data voltage and a second reference voltage at the reference voltage terminal; wherein, the second data voltage is provided to a control node in the pixel driving circuit, a difference value between the second reference voltage and a voltage at the control node is a fixed value, and the voltage at the control node is less than or equal to a threshold voltage of the light-emitting time control transistor.

A display device is further provided in the present disclosure, including the pixel driving circuit described above.

In an implementation, the display device further includes a silicon substrate, where the pixel driving circuit is disposed on the silicon substrate.

DETAILED DESCRIPTION

The technical solutions in the embodiments of the present disclosure will be described hereinafter clearly and completely with reference to the drawings of the embodiments of the present disclosure. Obviously, the following embodiments merely relate to a part of, rather than all of, the embodiments of the present disclosure, and based on these embodiments, a person skilled in the art may, without any creative effort, obtain other embodiments, which also fall within the scope of the present disclosure.

A transistor used in the embodiments of the present disclosure may be a triode, a thin film transistor, a field effect transistor or other device with same characteristics. In the embodiments of the present disclosure, in order to distinguish between two electrodes of the transistor other than a control electrode, one electrode of the two electrodes is referred to as a first electrode and the other electrode of the two electrodes is referred to as a second electrode.

In practice, when the transistor is a triode, the control electrode of the transistor may be a base electrode, the first electrode of the transistor may be a collector electrode, and the second electrode of the transistor may be an emitter electrode. Alternatively, the control electrode of the transistor may be a base electrode, the first electrode of the transistor may be an emitter electrode, and the second electrode of the transistor may be a collector electrode.

In practice, when the transistor is a thin film transistor or a field effect transistor, the control electrode of the transistor may be a gate electrode, the first electrode of the transistor may be a drain electrode, and the second electrode of the transistor may be a source electrode. Alternatively, the control electrode of the transistor may be a gate electrode, the first electrode of the transistor may be a source electrode, and the second electrode of the transistor may be a drain electrode.

In the related art, a driving method corresponding to a silicon substrate OLED is a voltage-type driving method, but a data voltage range in such a driving method of the related art is small, which is not conducive to a gray-scale segmentation.

In view of the above problem, a pixel driving circuit and a display device are provided in the present disclosure, to solve a problem in the related art that the data voltage range of the silicon substrate OLED display product is small, which is not conducive to the gray-scale segmentation and cannot realize more gray-scales and cannot reproduce low gray-scales well.

Figure 1:
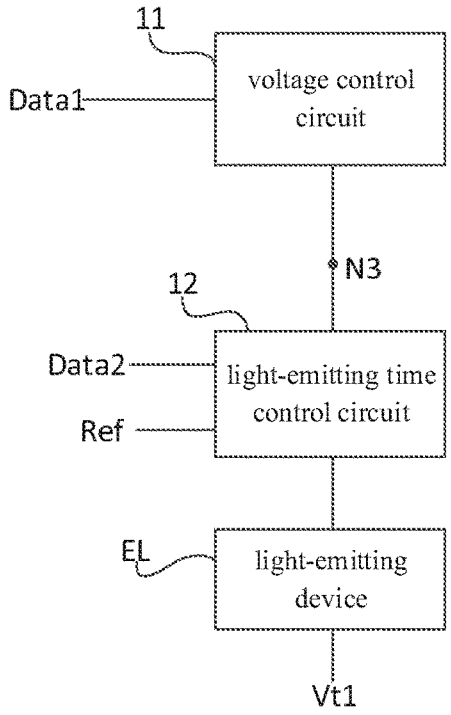
FIG. 1 is a structural diagram of a pixel driving circuit according to an embodiment of the present disclosure.

A pixel driving circuit is provided in an embodiment of the present disclosure. The pixel driving circuit is configured to drive a light-emitting device EL. As shown in FIG. 1, the pixel driving circuit includes a voltage control circuit 11 and a light-emitting time control circuit 12. The voltage control circuit 11 is electrically connected to a first data line Data1 and a voltage writing node N3 respectively, and configured to control a voltage at the voltage writing node N3 according to a first data voltage on the first data line Data1. The light-emitting time control circuit 12 is electrically connected to a second data line Data2, the voltage writing node N3, a reference voltage terminal Ref and a first electrode of the light-emitting device EL respectively, and configured to connect the voltage writing node N3 to the first electrode of the light-emitting device EL or disconnect the voltage writing node N3 from the first electrode of the light-emitting device EL according to a second data voltage on the second data line Data2 and a reference voltage at the reference voltage terminal Ref. A second electrode of the light-emitting device EL is electrically connected to a first voltage terminal Vt1.

In the embodiment of the present disclosure, the light-emitting device EL may be an organic light-emitting diode, but is not limited thereto.

In the embodiment of the present disclosure, the first voltage terminal Vt1 may be a low voltage terminal or a ground terminal, but is not limited thereto.

In the pixel driving circuit according to the embodiment of the present disclosure, the light-emitting time control circuit 12 controls light-emitting time of the light-emitting device EL according to the second data voltage and the reference voltage, and the voltage control circuit 11 controls the voltage at the voltage writing node N3. When the light-emitting time control circuit 12 connects the voltage writing node N3 to the first electrode of the light-emitting device EL, the light-emitting device EL emits light, and light-emitting brightness of the light-emitting device EL is related to a voltage difference between the first electrode of the light-emitting device EL and the second electrode of the light-emitting device EL.

The pixel driving circuit according to the embodiment of the present disclosure controls the light-emitting brightness according to the voltage difference between two electrodes of the light-emitting device EL and the light-emitting time, thus, the data voltage range is increased, more gray scales may be realized, and low gray-scales may be reproduced well.

In the embodiment of the present disclosure, the light-emitting device may be a silicon substrate organic light-emitting diode (OLED), the first electrode of the light-emitting device is an anode of the silicon substrate OLED, and the second electrode of the light-emitting device is a cathode of the silicon substrate OLED, which are not limited thereto.

In the related silicon substrate OLED display technology, due to a small pixel size, a pixel current of the silicon substrate OLED merely ranges from hundreds of picoampere (pA) to tens of nanoampere (nA), and if a metal oxide semiconductor-field effect transistor (MOSFET) operates in a deep saturation region and outputs a small current, a length of a driving transistor will reach tens or even hundreds of micrometer (um), which is not feasible for micro display. Therefore, a current driving method employed in an active-matrix organic light-emitting diode (AMOLED) cannot be used in the silicon substrate OLED. Instead, a voltage driving method and a light-emitting time control method are used to output the small current required by the silicon substrate OLED.

When the pixel driving circuit as shown in FIG. 1 according to the embodiment of the present disclosure is in operation, a display period includes a first data writing stage, a second data writing stage and a light-emitting stage. In the first data writing stage, a first data voltage Vdata1 is provided on the first data line Data1, and the voltage control circuit 11 controls the voltage at the voltage writing node N3 to be a first control voltage Vc1 according to the first data voltage Vdata1. In the second data writing stage, a second data voltage Vdata2 is provided to the light-emitting time control circuit 12 through the second data line Data2, and at this time the light-emitting time control circuit 12 may disconnect the voltage writing node N3 from the first electrode of the light-emitting device EL. In the light-emitting stage, a reference voltage Vref at the reference voltage terminal Ref changes with time. The light-emitting time control circuit 12 switches a connection between the voltage writing node N3 and the first electrode of the light-emitting device EL from a disconnected status to a connected status according to the second data voltage Vdata2 and the reference voltage Vref at the reference voltage terminal Ref. The light-emitting time of the light-emitting device EL may be controlled according to the second data voltage Vdata2 and the reference voltage Vref.

When the pixel driving circuit as shown in FIG. 1 according to the embodiment of the present disclosure is in operation, the light-emitting brightness of the light-emitting device EL is related to the voltage difference between the first electrode of the light-emitting device EL and the second electrode of the light-emitting device EL in the light-emitting stage.

When the pixel driving circuit as shown in FIG. 1 according to the embodiment of the present disclosure is in operation, the light-emitting time control circuit may also switch the connection between the voltage writing node N3 and the first electrode of the light-emitting device EL from a connected status to a disconnected status in the light-emitting stage, but is not limited thereto.

In the embodiment of the present disclosure, in the light-emitting stage, the reference voltage Vref at the reference voltage terminal Ref may change linearly with time, for example, the reference voltage Vref decreases linearly, but is not limited thereto. In the light-emitting stage, the light-emitting time of the light-emitting device EL is related to Vdata2 and Vref.

In an implementation, the light-emitting time control circuit may include a light-emitting time control transistor, a second data voltage writing circuit and a time control capacitor. A control electrode of the light-emitting time control transistor is electrically connected to a control node, a first electrode of the light-emitting time control transistor is electrically connected to the voltage writing node, and a second electrode of the light-emitting time control transistor is electrically connected to the first electrode of the light-emitting device. The second data voltage writing circuit is electrically connected to the second data line and the control node respectively and configured to write the second data voltage on the second data line to the control node under control of a second data voltage writing control signal. A first terminal of the time control capacitor is electrically connected to the control node, and a second terminal of the time control capacitor is electrically connected to the reference voltage terminal.

Figure 2:
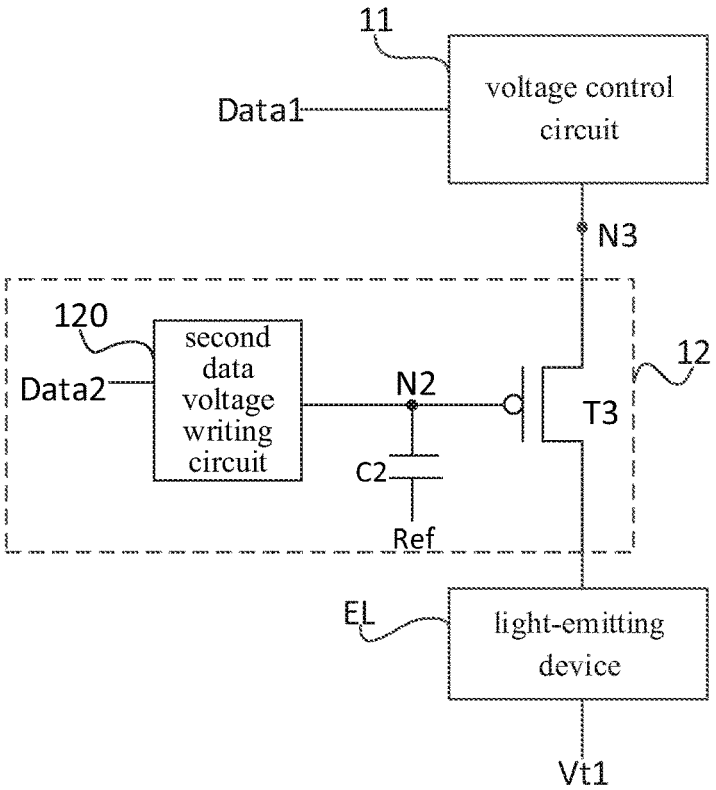
FIG. 2 is another structural diagram of a pixel driving circuit according to an embodiment of the present disclosure.

As shown in FIG. 2, on the basis of the embodiment of the pixel driving circuit shown in FIG. 1, the light-emitting device is an organic light emitting diode OE; a cathode of the OE is inputted with a low voltage VSS. The light-emitting time control circuit 12 includes a light-emitting time control transistor T3, a second data voltage writing circuit 120 and a time control capacitor C2. A gate electrode of the light-emitting time control transistor T3 is electrically connected to a control node N2, a source electrode of the light-emitting time control transistor T3 is electrically connected to the voltage writing node N3, and a drain electrode of the light-emitting time control transistor T3 is electrically connected to an anode of the organic light emitting diode OE. The second data voltage writing circuit 120 is electrically connected to the second data line Data2 and the control node N2 respectively, and configured to write the second data voltage Vdata2 on the second data line Data2 to the control node N2 under control of a second data voltage writing control signal. A first terminal of the time control capacitor C2 is electrically connected to the control node N2, and a second terminal of the time control capacitor is electrically connected to the reference voltage terminal Ref.

In the embodiment as shown in FIG. 2, T3 is a P-type metal-oxide-semiconductor (PMOS) transistor, but is not limited thereto.

When the pixel driving circuit as shown in FIG. 2 according to the embodiment of the present disclosure is in operation, the display period includes the first data writing stage, the second data writing stage and the light-emitting stage. In the first data writing stage, the first data voltage Vdata1 is provided on the first data line, and the voltage control circuit 11 controls the voltage at the voltage writing node N3 to be the first control voltage Vc1 according to the first data voltage Vdata1. In the second data writing stage, the second data voltage Vdata2 is provided to the gate electrode of T3 through the second data line Data2, to turn off T3. In the light-emitting stage, the reference voltage Vref at the reference voltage terminal Ref decreases linearly with time. The light-emitting time control circuit 12 switches a connection between the voltage writing node N3 and the anode of the organic light emitting diode OE from a disconnected status to a connected status according to the second data voltage Vdata2 and the reference voltage Vref at the reference voltage terminal Ref. The light-emitting time of the organic light-emitting diode OE may be controlled according to the second data voltage Vdata2 and the reference voltage Vref.

In an implementation, the second data voltage writing circuit includes a first transistor and a second transistor. The second data voltage writing control signal includes a first gate driving signal and a second gate driving signal. A control electrode of the first transistor is electrically connected to a first gate line, a first electrode of the first transistor is electrically connected to the second data line, and a second electrode of the first transistor is electrically connected to the control node. A control electrode of the second transistor is electrically connected to a second gate line, a first electrode of the second transistor is electrically connected to the second data line, and a second electrode of the second transistor is electrically connected to the control node. The first gate line is configured to provide the first gate driving signal, and the second gate line is configured to provide the second gate driving signal. The first transistor is an n-type transistor, and the second transistor is a p-type transistor.

In a specific implementation, the second data voltage writing circuit may include two transistors of opposite types to expand a range of the second data voltage on the second data line that can be written to the control node. For example, the first transistor may also be a p-type transistor, and correspondingly the second transistor is an n-type transistor.

To be specific, the pixel driving circuit in the embodiment of the present disclosure may further include a light-emitting control circuit. The light-emitting control circuit is connected between the light-emitting time control circuit and the first electrode of the light-emitting device, and configured to connect the light-emitting time control circuit to the first electrode of the light-emitting device under control of a light-emitting control signal on a light-emitting control line.

In a specific implementation, the pixel driving circuit in the embodiment of the present disclosure may further include the light-emitting control circuit, and the light-emitting control circuit may connect the light-emitting time control circuit to the first electrode of the light-emitting device or disconnect the light-emitting time control circuit from the first electrode of the light-emitting device under control of the light-emitting control signal.

Figure 3:
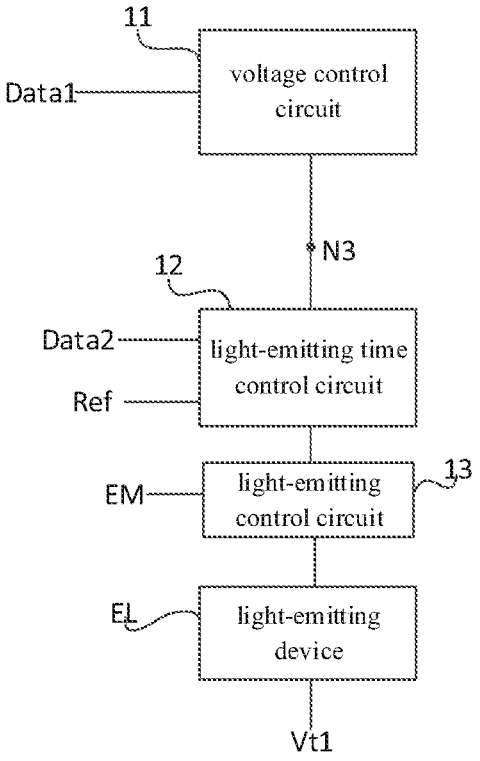
FIG. 3 is still another structural diagram of a pixel driving circuit according to an embodiment of the present disclosure.

As shown in FIG. 3, on the basis of the embodiment of the pixel driving circuit shown in FIG. 1, the pixel driving circuit according to the embodiment of the present disclosure may further include a light-emitting control circuit 13. The light-emitting control circuit 13 is connected between the light-emitting time control circuit 12 and the first electrode of the light-emitting device EL, and the light-emitting control circuit 13 is electrically connected to a light-emitting control line EM. The light-emitting control circuit 13 is configured to connect the light-emitting time control circuit 12 to the first electrode of the light-emitting device EL under control of a light-emitting control signal on the light-emitting control line EM.

When the pixel driving circuit as shown in FIG. 3 according to the embodiment of the present disclosure is in operation, the light-emitting control circuit 13 connects the light-emitting time control circuit 12 to the first electrode of the light-emitting device EL under control of the light-emitting control signal on the light-emitting control line EM in the light-emitting stage.

To be specific, the light-emitting control circuit includes a light-emitting control transistor, a control electrode of the light-emitting control transistor is electrically connected to the light-emitting control line, a first electrode of the light-emitting control transistor is electrically connected to the light-emitting time control circuit, and a second electrode of the light-emitting control transistor is electrically connected to the first electrode of the light-emitting device.

To be specific, the voltage control circuit includes a first data voltage writing circuit, a source follower transistor and a storage capacitor. A gate electrode of the source follower transistor is electrically connected to a first node, a drain electrode of the source follower transistor is electrically connected to a power supply voltage terminal, and a source electrode of the source follower transistor is electrically connected to the voltage writing node. The first data voltage writing circuit is electrically connected to the first data line and the first node respectively, and configured to write the first data voltage on the first data line to the first node under control of a first data voltage writing control signal. A first terminal of the storage capacitor is electrically connected to the first node, and a second terminal of the storage capacitor is electrically connected to the power supply voltage terminal.

In a specific implementation, the voltage control circuit may include the first data voltage writing circuit, the source follower transistor and the storage capacitor, the first data voltage writing circuit writes the first data voltage Vdata1 to a first node N1 under control of the first data voltage writing control signal, a voltage on a source electrode of the source follower transistor changes with a voltage at the first node N1

Figure 4:
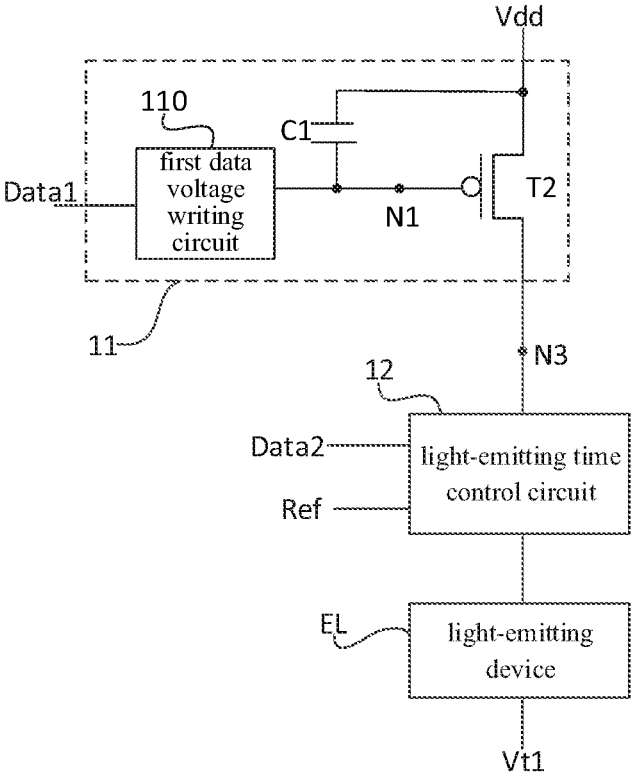
FIG. 4 is yet another structural diagram of a pixel driving circuit according to an embodiment of the present disclosure.

As shown in FIG. 4, on the basis of the embodiment of the pixel driving circuit shown in FIG. 1, the voltage control circuit 11 may include a first data voltage writing circuit 110, a source follower transistor T2 and a storage capacitor C1. A gate electrode of the source follower transistor T2 is electrically connected to the first node N1, a drain electrode of the source follower transistor T2 is electrically connected to the power supply voltage terminal, and a source electrode of the source follower transistor T2 is electrically connected to the voltage writing node N3. The power supply voltage terminal is configured to provide a power supply voltage Vdd. The first data voltage writing circuit 110 is electrically connected to the first data line Data1 and the first node N1 respectively, and configured to write the first data voltage Vdata1 on the first data line Data1 to the first node N1 under control of the first data voltage writing control signal. A first terminal of the storage capacitor C1 is electrically connected to the first node N1, and a second terminal of the storage capacitor C1 is electrically connected to the power supply voltage terminal.

In the embodiment shown in FIG. 4, T2 is an n-type transistor, but is not limited thereto.

When the pixel driving circuit as shown in FIG. 4 according to the embodiment of the present disclosure is in operation, in the first data writing stage, the first data voltage writing circuit 110 writes the first data voltage Vdata1 to the first node N1, and then the voltage at N3 changes with the voltage at N1 accordingly. In the second data writing stage and the light-emitting stage, the voltage at N3 remains unchanged. In the light-emitting stage, when the light-emitting device EL emits light, the light-emitting brightness of the light-emitting device EL is related to a voltage difference between the voltage at N3 and the voltage on the second electrode of the light-emitting device EL, where the voltage difference is larger than a turn-on voltage of the light-emitting device EL.

To be specific, the first data voltage writing control signal may include a third gate driving signal and a fourth gate driving signal. The first data voltage writing circuit includes a third transistor and a fourth transistor. A control electrode of the third transistor is electrically connected to a third gate line, a first electrode of the third transistor is electrically connected to the first data line, and a second electrode of the third transistor is electrically connected to the first node. A control electrode of the fourth transistor is electrically connected to a fourth gate line, a first electrode of the fourth transistor is electrically connected to the first data line, and a second electrode of the fourth transistor is electrically connected to the first node. The third gate line is configured to provide the third gate driving signal, and the fourth gate line is configured to provide the fourth gate driving signal. The third transistor is an n-type transistor, and the fourth transistor is a p-type transistor.

In a specific implementation, the first data voltage writing circuit may include two transistors of opposite types to expand a range of the first data voltage on the first data line that can be written to the first node. For example, the third transistor may also be a p-type transistor, and correspondingly the fourth transistor is an n-type transistor.

The pixel driving circuit of the present disclosure is described in the following with reference to a specific embodiment.

Figure 5:
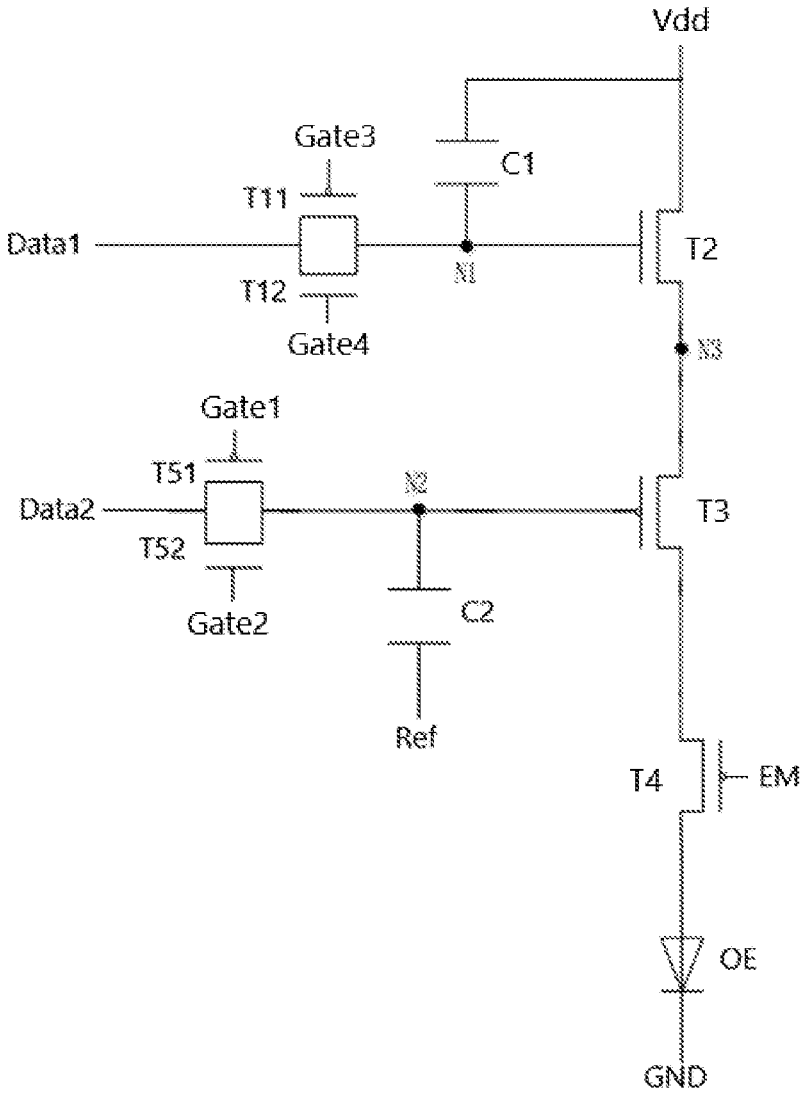
FIG. 5 is a circuit diagram of a specific embodiment of a pixel driving circuit according to the present disclosure.

As shown in FIG. 5, the pixel driving circuit in an embodiment of the present disclosure is configured to drive the organic light emitting diode OE. The pixel driving circuit includes the voltage control circuit, the light-emitting time control circuit and the light-emitting control circuit. The light-emitting time control circuit includes the light-emitting time control transistor T3, the second data voltage writing circuit and the time control capacitor C2. The gate electrode of the light-emitting time control transistor T3 is electrically connected to the control node N2, the source electrode of the light-emitting time control transistor T3 is electrically connected to the voltage writing node N3. The first terminal of the time control capacitor C2 is electrically connected to the control node N2, and the second terminal of the time control capacitor C2 is electrically connected to the reference voltage terminal Ref. The second data voltage writing circuit includes a first transistor T51 and a second transistor T52, the first transistor is an n-type transistor, and the second transistor is a p-type transistor. A gate electrode of the first transistor T51 is electrically connected to a first gate line Gate1, a source electrode of the first transistor T51 is electrically connected to a second data line Data2, and a drain electrode of the first transistor T51 is electrically connected to the control node N2. A gate electrode of the second transistor T52 is electrically connected to a second gate line Gate2, a drain electrode of the second transistor T52 is electrically connected to the second data line Data2, and a source electrode of the second transistor T52 is electrically connected to the control node N2. The first gate line Gate1 is configured to provide a first gate driving signal, and the second gate line Gate2 is configured to provide a second gate driving signal. The light-emitting control circuit includes a light-emitting control transistor T4, a gate electrode of the light-emitting control transistor T4 is electrically connected to the light-emitting control line EM, a source electrode of the light-emitting control transistor T4 is electrically connected to the drain electrode of the light-emitting time control transistor T3, a drain electrode of the light-emitting control transistor T4 is electrically connected to the anode of an organic light-emitting diode OE, and the cathode of the organic light-emitting diode OE is electrically connected to a ground terminal GND. The voltage control circuit includes the first data voltage writing circuit, the source follower transistor T2 and the storage capacitor C1. The gate electrode of the source follower transistor T2 is electrically connected to the first node N1, the drain electrode of the source follower transistor T2 is electrically connected to the power supply voltage terminal, and the source electrode of the source follower transistor T2 is electrically connected to the voltage writing node N3; the power supply voltage terminal is configured to provide the power supply voltage Vdd. The first terminal of the storage capacitor C1 is electrically connected to the first node N1, and the second terminal of the storage capacitor C1 is electrically connected to the power supply voltage terminal. The first data voltage writing circuit includes a third transistor T11 and a fourth transistor T12, the third transistor T11 is an n-type transistor, and the fourth transistor T12 is a p-type transistor. A gate electrode of the third transistor T11 is electrically connected to a third gate line Gate3, a source electrode of the third transistor T11 is electrically connected to the first data line Data1, and a drain electrode of the third transistor T11 is electrically connected to the first node N1. A gate electrode of the fourth transistor T12 is electrically connected to a fourth gate line Gate4, a drain electrode of the fourth transistor T12 is electrically connected to the first data line Data1, and a source electrode of the fourth transistor T12 is electrically connected to the first node N1. The third gate line Gate3 is configured to provide a third gate driving signal, and the fourth gate line Gate4 is configured to provide a fourth gate driving signal.

In the specific embodiment shown in FIG. 5, the third transistor T11 is an N-type metal-oxide-semiconductor (NMOS) transistor, the fourth transistor T12 is a PMOS transistor; the first transistor T51 is an NMOS transistor, the second transistor T52 is a PMOS transistor; T3 and T4 are PMOS transistors, and T2 is an NMOS transistor.

In the specific embodiment shown in FIG. 5, T2 is the source follower transistor.

When T2 is in operation, a relationship between a voltage Vs on the source electrode of T2 and a voltage Vg on the gate electrode of T2 is as follows: Vs=kVg+b. Both k and b may be real numbers. When k and b are constants, Vs changes linearly with Vg. Values of k and b may be determined by manufacturing process parameters of the source follower transistor.

Figure 6:
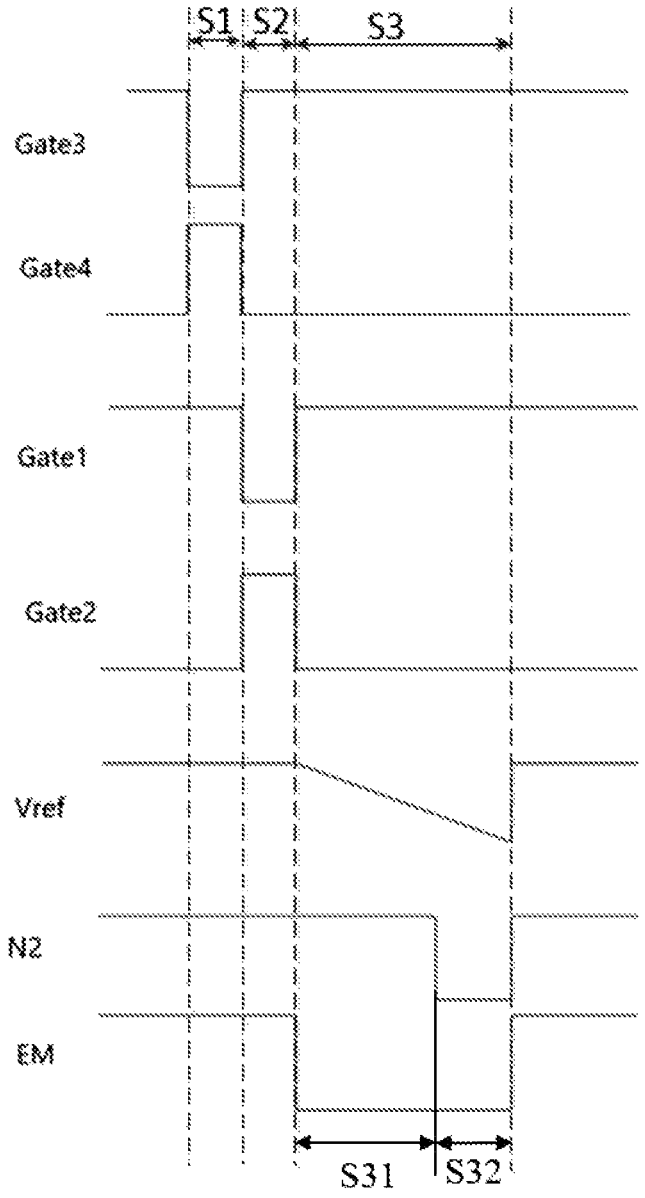
FIG. 6 is an operation time-sequence diagram of the specific embodiment of a pixel driving circuit according to the present disclosure.

As shown in FIG. 6, when the pixel driving circuit shown in FIG. 5 according to a specific embodiment of the present disclosure is in operation, the display period includes a first data writing stage S1, a second data writing stage S2 and a light emitting stage S3 that are sequentially arranged.

In the first data writing stage S1, a low level is inputted to Gate3, a high level is inputted to Gate4, a high level is inputted to Gate1, a low level is inputted to Gate2, T11 and T12 are turned on, T51 and T52 are turned off. The first data line Data1 provides first data voltage Vdata1 to the first node N1, so that the voltage at N3 becomes k×Vdata1+b, and the voltage at N3 is larger than a turn-on voltage of OE. C1 maintains the voltage at N1.

In the second data writing stage S2, a high level is inputted to Gate3, a low level is inputted to Gate4, a low level is inputted to Gate1, a high level is inputted to Gate2, T11 and T12 are turned off, T51 and T52 are turned on. The second data line Data2 provides second data voltage Vdata2 to N2, and at this time T3 is turned off.

In the light-emitting stage S3, a reference voltage Vref is written to Ref. As shown in FIG. 6, Vref changes with time in the light-emitting stage S3, and Vref decreases linearly. As can be known from the bootstrap characteristic of a capacitor, Vref-Vn2 is a fixed value, where Vn2 is a voltage at N2. When Vref changes, the voltage at N2 also changes. When the voltage at N2 is equal to a threshold voltage Vth of T3 or the voltage at N2 is less than Vth, T3 is turned on, thereby light-emitting time of OE is controlled. That is, the voltage at N2 controls turn-on time of T3, and further controls gray-scales of OE by means of a length of the light-emitting time.

When the pixel driving circuit in the embodiment of the present disclosure is in operation, the display period includes the first data writing stage, the second data writing stage and the light-emitting stage.

In the first data writing stage, the first data voltage is provided through the first data line, and the voltage control circuit controls the voltage at the voltage writing node to be the first control voltage Vc1 according to the first data voltage, In the second data writing stage, the second data line provides the second data voltage to the light-emitting time control circuit.

In the light-emitting stage, the light-emitting time control circuit connects the voltage writing node to the first electrode of the light-emitting device or disconnects the voltage writing node from the first electrode of the light-emitting device according to the second data voltage and the reference voltage at the reference voltage terminal.

In the embodiment of the present disclosure, the light-emitting time control circuit controls the light-emitting time of the light-emitting device according to the second data voltage and the reference voltage, and the voltage control circuit controls the voltage at the voltage writing node. When the light-emitting time control circuit connects the voltage writing node to the first electrode of the light-emitting device, the light-emitting device EL emits light, and the light-emitting brightness of the light-emitting device is related to a voltage difference between the first electrode of the light-emitting device and the second electrode of the light-emitting device.

To be specific, the light-emitting time control circuit may include the light-emitting time control transistor, the second data voltage writing circuit and the time control capacitor. That the second data line provides the second data voltage to the light-emitting time control circuit in the second data writing stage may include: in the second data writing stage, the second data line provides the second data voltage Vdata2 to the control node, so that the light-emitting time control circuit disconnects the voltage writing node from the first electrode of the light-emitting device. The light-emitting stage includes the light-emitting preparation time period and the light-emitting time period. That the light-emitting time control circuit connects the voltage writing node to the first electrode of the light-emitting device or disconnects the voltage writing node from the first electrode of the light-emitting device according to the second data voltage and the reference voltage at the reference voltage terminal includes: in the light-emitting preparation time period, the reference voltage terminal provides the reference voltage to the second terminal of the time control capacitor, the reference voltage changes with time, thereby the voltage at the control node is controlled to change with time, and the light-emitting time control circuit disconnects the voltage writing node from the first electrode of the light-emitting device according to the second data voltage and a first reference voltage at the reference voltage terminal. In the light-emitting time period, the reference voltage terminal provides the reference voltage to the second terminal of the time control capacitor, the reference voltage changes with time, thereby the voltage at the control node is controlled to change with time, and the light-emitting time control circuit connects the voltage writing node to the first electrode of the light-emitting device according to the second data voltage and a second reference voltage at the reference voltage terminal; the second data voltage is provided to the control node in the pixel driving circuit, a difference value between the second reference voltage and the voltage at the control node is a fixed value, and the voltage at the control node is less than or equal to a threshold voltage of the light-emitting time control transistor.

As shown in FIG. 6, a light-emitting stage S3 includes a light-emitting preparation time period S31 and a light-emitting time period S32.

In a specific implementation, the light-emitting time control circuit may include the light-emitting time control transistor, the second data voltage writing circuit and the time control capacitor. The light-emitting stage may include the light-emitting preparation time period and the light-emitting time period, the light-emitting device does not emit light in the light-emitting preparation time period, and the light-emitting device emits light in the light-emitting time period. The duration of the light-emitting time period is related to the reference voltage and the second data voltage. The duration of the light-emitting time period is the light-emitting time of the light-emitting device. The light-emitting time may be adjusted by adjusting the reference voltage and the second data voltage.

To be specific, the pixel driving circuit may further include the light-emitting control circuit. In the light-emitting stage, the light-emitting control circuit connects the light-emitting time control circuit to the first electrode of the light-emitting device under control of the light-emitting control signal on the light-emitting control line.

A display device according to an embodiment of the present disclosure includes the pixel driving circuit described above.

To be specific, the display device in the embodiment of the present disclosure further includes a silicon substrate, the pixel driving circuit is disposed on the silicon substrate.

A method for driving the pixel driving circuit described above is further provided in an embodiment of the present disclosure, including: in the first data writing stage, controlling, by the voltage control circuit, the voltage at the voltage writing node to be the first control voltage according to the first data voltage on the first data line; in the second data writing stage, disconnecting, by the light-emitting time control circuit, the voltage writing node from the first electrode of the light-emitting device according to the second data voltage on the second data line; and in the light-emitting stage, switching, by the light-emitting time control circuit, a connection between the voltage writing node and the first electrode of the light-emitting device from a disconnected status to a connected status according to the second data voltage and the reference voltage at the reference voltage terminal; the reference voltage at the reference voltage terminal changes with time.

In some embodiments, the reference voltage at the reference voltage terminal changes linearly with time.

For example, as shown in FIG. 6, the reference voltage at the reference voltage terminal decreases linearly with time.

In some embodiments, the pixel driving circuit may further include the light-emitting control circuit. The method includes: in the light-emitting stage, connecting, by the light-emitting control circuit, the light-emitting time control circuit to the first electrode of the light-emitting device under control of the light-emitting control signal on the light-emitting control line.

In some embodiments, the light-emitting time control circuit includes the light-emitting time control transistor, the light-emitting stage includes the light-emitting preparation time period and the light-emitting time period, and the switching, by the light-emitting time control circuit, a connection between the voltage writing node and the first electrode of the light-emitting device from a disconnected status to a connected status according to the second data voltage and the reference voltage at the reference voltage terminal in the light-emitting stage includes: in the light-emitting preparation time period, disconnecting, by the light-emitting time control circuit, the voltage writing node from the first electrode of the light-emitting device according to the second data voltage and the first reference voltage at the reference voltage terminal; in the light-emitting time period, connecting, by the light-emitting time control circuit, the voltage writing node to the first electrode of the light-emitting device according to the second data voltage and the second reference voltage at the reference voltage terminal; the second data voltage is provided to the control node in the pixel driving circuit, the difference value between the second reference voltage and the voltage at the control node is a fixed value, and the voltage at the control node is less than or equal to the threshold voltage of the light-emitting time control transistor.

The display device in the embodiment of the present disclosure may be any product or unit having a display function, such as a VR device, a mobile phone, a tablet computer, a television, a display, a notebook computer, a digital photo frame, or a navigator.

The above are optional embodiments of the present disclosure. It should be appreciated that, a person skilled in the art may make further modifications and improvements without departing from the principle of the present disclosure, and these modifications and improvements shall also be deemed as falling within the scope of the present disclosure.

The invention claimed is:

1. A pixel driving circuit, comprising a voltage control circuit and a light-emitting time control circuit, wherein the voltage control circuit is electrically connected to a first data line and a voltage writing node respectively, and configured to control a voltage at the voltage writing node according to a first data voltage on the first data line;

the light-emitting time control circuit is electrically connected to a second data line, the voltage writing node, a reference voltage terminal and a first electrode of a light-emitting device respectively, and configured to connect the voltage writing node to the first electrode of the light-emitting device or disconnect the voltage writing node from the first electrode of the light-emitting device according to a second data voltage on the second data line and a reference voltage at the reference voltage terminal;

a second electrode of the light-emitting device is electrically connected to a first voltage terminal;

the light-emitting time control circuit comprises a light-emitting time control transistor, a second data voltage writing circuit and a time control capacitor;

a control electrode of the light-emitting time control transistor is electrically connected to a control node, a first electrode of the light-emitting time control transistor is electrically connected to the voltage writing node, and a second electrode of the light-emitting time control transistor is electrically connected to the first electrode of the light-emitting device;

the second data voltage writing circuit is electrically connected to the second data line and the control node respectively, and configured to write the second data voltage on the second data line to the control node under control of a second data voltage writing control signal; and a first terminal of the time control capacitor is electrically connected to the control node, and a second terminal of the time control capacitor is electrically connected to the reference voltage terminal.

2. The pixel driving circuit according to claim 1, wherein the second data voltage writing circuit comprises a first transistor and a second transistor; the second data voltage writing control signal comprises a first gate driving signal and a second gate driving signal;

a control electrode of the first transistor is electrically connected to a first gate line, a first electrode of the first transistor is electrically connected to the second data line, and a second electrode of the first transistor is electrically connected to the control node;

a control electrode of the second transistor is electrically connected to a second gate line, a first electrode of the second transistor is electrically connected to the second data line, and a second electrode of the second transistor is electrically connected to the control node;

the first gate line is configured to provide the first gate driving signal, and the second gate line is configured to provide the second gate driving signal;

the first transistor is an n-type transistor, and the second transistor is a p-type transistor.

3. The pixel driving circuit according to claim 1, further comprising a light-emitting control circuit;

the light-emitting control circuit is connected between the light-emitting time control circuit and the first electrode of the light-emitting device, and configured to connect the light-emitting time control circuit to the first electrode of the light-emitting device under control of a light-emitting control signal on a light-emitting control line.

4. The pixel driving circuit according to claim 3, wherein the light-emitting control circuit comprises a light-emitting control transistor;

a control electrode of the light-emitting control transistor is electrically connected to the light-emitting control line, a first electrode of the light-emitting control transistor is electrically connected to the light-emitting time control circuit, and a second electrode of the light-emitting control transistor is electrically connected to the first electrode of the light-emitting device.

5. The pixel driving circuit according to claim 1, wherein the voltage control circuit comprises a first data voltage writing circuit, a source follower transistor and a storage capacitor;

a gate electrode of the source follower transistor is electrically connected to a first node, a drain electrode of the source follower transistor is electrically connected to a power supply voltage terminal, and a source electrode of the source follower transistor is electrically connected to the voltage writing node;

the first data voltage writing circuit is electrically connected to the first data line and the first node respectively, and configured to write the first data voltage on the first data line to the first node under control of a first data voltage writing control signal; and a first terminal of the storage capacitor is electrically connected to the first node, and a second terminal of the storage capacitor is electrically connected to the power supply voltage terminal.

6. The pixel driving circuit according to claim 5, wherein the first data voltage writing control signal comprises a third gate driving signal and a fourth gate driving signal;

the first data voltage writing circuit comprises a third transistor and a fourth transistor;

a control electrode of the third transistor is electrically connected to a third gate line, a first electrode of the third transistor is electrically connected to the first data line, and a second electrode of the third transistor is electrically connected to the first node;

a control electrode of the fourth transistor is electrically connected to a fourth gate line, a first electrode of the fourth transistor is electrically connected to the first data line, and a second electrode of the fourth transistor is electrically connected to the first node;

the third gate line is configured to provide the third gate driving signal, and the fourth gate line is configured to provide the fourth gate driving signal;

the third transistor is an n-type transistor, and the fourth transistor is a p-type transistor.

7. The pixel driving circuit according to claim 1, further comprising a light-emitting control circuit; wherein a gate electrode of the light-emitting time control transistor is electrically connected to a control node, and a source electrode of the light-emitting time control transistor is electrically connected to the voltage writing node;

the second data voltage writing circuit comprises a first transistor and a second transistor, the first transistor is an n-type transistor, and the second transistor is a p-type transistor;

a gate electrode of the first transistor is electrically connected to a first gate line, a source electrode of the first transistor is electrically connected to a second data line, and a drain electrode of the first transistor is electrically connected to the control node;

a gate electrode of the second transistor is electrically connected to a second gate line, a drain electrode of the second transistor is electrically connected to the second data line, and a source electrode of the second transistor is electrically connected to the control node;

the first gate line is configured to provide a first gate driving signal, and the second gate line is configured to provide a second gate driving signal;

the light-emitting control circuit comprises a light-emitting control transistor;

a gate electrode of the light-emitting control transistor is electrically connected to a light-emitting control line, a source electrode of the light-emitting control transistor is electrically connected to a drain electrode of the light-emitting time control transistor, a drain electrode of the light-emitting control transistor is electrically connected to an anode of an organic light-emitting diode, and a cathode of the organic light-emitting diode is electrically connected to the first voltage terminal;

the voltage control circuit comprises a first data voltage writing circuit, a source follower transistor and a storage capacitor;

a gate electrode of the source follower transistor is electrically connected to a first node, a drain electrode of the source follower transistor is electrically connected to a power supply voltage terminal, and a source electrode of the source follower transistor is electrically connected to the voltage writing node; the power supply voltage terminal is configured to provide a power supply voltage;

a first terminal of the storage capacitor is electrically connected to the first node, and a second terminal of the storage capacitor is electrically connected to the power supply voltage terminal;

the first data voltage writing circuit comprises a third transistor and a fourth transistor, the third transistor is an n-type transistor, and the fourth transistor is a p-type transistor;

a gate electrode of the third transistor is electrically connected to a third gate line, a source electrode of the third transistor is electrically connected to the first data line, and a drain electrode of the third transistor is electrically connected to the first node;

a gate electrode of the fourth transistor is electrically connected to a fourth gate line, a drain electrode of the fourth transistor is electrically connected to the first data line, and a source electrode of the fourth transistor is electrically connected to the first node;

the third gate line is configured to provide a third gate driving signal, and the fourth gate line is configured to provide a fourth gate driving signal.

8. A display device comprising the pixel driving circuit according to claim 1.

9. The display device according to claim 8, further comprising a silicon substrate, wherein the pixel driving circuit is disposed on the silicon substrate.

10. A pixel driving method, applied to a pixel driving circuit comprising a voltage control circuit and a light-emitting time control circuit, wherein the voltage control circuit is electrically connected to a first data line and a voltage writing node respectively, and configured to control a voltage at the voltage writing node according to a first data voltage on the first data line;

the light-emitting time control circuit is electrically connected to a second data line, the voltage writing node, a reference voltage terminal and a first electrode of a light-emitting device respectively, and configured to connect the voltage writing node to the first electrode of the light-emitting device or disconnect the voltage writing node from the first electrode of the light-emitting device according to a second data voltage on the second data line and a reference voltage at the reference voltage terminal; and a second electrode of the light-emitting device is electrically connected to a first voltage terminal, the method further comprising:

in a first data writing stage, controlling, by the voltage control circuit, the voltage at the voltage writing node to be a first control voltage according to the first data voltage on the first data line;

in a second data writing stage, disconnecting, by the light-emitting time control circuit, the voltage writing node from the first electrode of the light-emitting device according to the second data voltage on the second data line; and in a light-emitting stage, switching, by the light-emitting time control circuit, a connection between the voltage writing node and the first electrode of the light-emitting device from a disconnected status to a connected status according to the second data voltage and the reference voltage at the reference voltage terminal; wherein the reference voltage at the reference voltage terminal changes with time.

11. The pixel driving method according to claim 10, wherein the reference voltage at the reference voltage terminal changes linearly with time.

12. The pixel driving method according to claim 10, wherein in case that the pixel driving circuit further comprises a light-emitting control circuit, the method further comprises:

in the light-emitting stage, connecting, by the light-emitting control circuit, the light-emitting time control circuit to the first electrode of the light-emitting device under control of a light-emitting control signal on a light-emitting control line.

13. The pixel driving method according to claim 10, wherein in case that the light-emitting time control circuit comprises a light-emitting time control transistor, the light-emitting stage comprises a light-emitting preparation time period and a light-emitting time period, and the switching, by the light-emitting time control circuit, a connection between the voltage writing node and the first electrode of the light-emitting device from a disconnected status to a connected status according to the second data voltage and the reference voltage at the reference voltage terminal in the light-emitting stage comprises:

in the light-emitting preparation time period, disconnecting, by the light-emitting time control circuit, the voltage writing node from the first electrode of the light-emitting device according to the second data voltage and a first reference voltage at the reference voltage terminal;

in the light-emitting time period, connecting, by the light-emitting time control circuit, the voltage writing node to the first electrode of the light-emitting device according to the second data voltage and a second reference voltage at the reference voltage terminal; wherein, the second data voltage is provided to a control node in the pixel driving circuit, a difference value between the second reference voltage and a voltage at the control node is a fixed value, and the voltage at the control node is less than or equal to a threshold voltage of the light-emitting time control transistor.

* * * * *